US008541635B2

(12) United States Patent
Landschof

(10) Patent No.: US 8,541,635 B2
(45) Date of Patent: Sep. 24, 2013

(54) DIESEL FUEL COMPOSITIONS

(75) Inventor: Jörg Landschof, Hamburg (DE)

(73) Assignee: Shell Oil Company, Houston, TX (US)

( * ) Notice: Subject to any disclaimer, the term of this patent is extended or adjusted under 35 U.S.C. 154(b) by 676 days.

(21) Appl. No.: 11/683,895

(22) Filed: Mar. 8, 2007

(65) Prior Publication Data

US 2007/0265479 A1 Nov. 15, 2007

(30) Foreign Application Priority Data

Mar. 10, 2006 (EP) ..... 06110936

(51) Int. Cl.
*C10L 1/16* (2006.01)

(52) U.S. Cl.
USPC ..... 585/14

(58) Field of Classification Search
USPC ..... 585/14
See application file for complete search history.

(56) References Cited

U.S. PATENT DOCUMENTS

| | | | |
|---|---|---|---|
| 4,208,190 | A | 6/1980 | Malec |
| 5,490,864 | A | 2/1996 | Herbstman et al. |
| 6,150,575 | A | 11/2000 | Angevine et al. |
| 6,204,426 | B1 | 3/2001 | Miller et al. |
| 2002/0151756 | A1 | 10/2002 | Schilowitz et al. |
| 2005/0277794 | A1 | 12/2005 | Cracknell et al. |

FOREIGN PATENT DOCUMENTS

| | | | |
|---|---|---|---|
| DE | 10038428 | | 2/2002 |
| EP | 147873 | | 7/1985 |
| EP | 147240 | | 4/1989 |
| EP | 0482253 | | 4/1992 |
| EP | 557516 | | 9/1993 |
| EP | 583836 | | 2/1994 |
| EP | 613938 | | 7/1998 |
| EP | 1101813 | | 5/2001 |
| EP | 1619232 | | 3/2005 |
| EP | 1619232 | * | 1/2006 |
| GB | 960493 | | 6/1964 |
| GB | 2077289 | | 12/1981 |
| WO | 9417160 | | 8/1994 |
| WO | 9533805 | | 12/1995 |
| WO | 9714768 | | 4/1997 |
| WO | 9714769 | | 4/1997 |
| WO | 9801516 | | 1/1998 |
| WO | 9842808 | | 10/1998 |
| WO | 0011116 | | 3/2000 |
| WO | 0011117 | | 3/2000 |
| WO | 0020534 | | 4/2000 |
| WO | 0020535 | | 4/2000 |
| WO | 0183406 | | 11/2001 |
| WO | 0183641 | | 11/2001 |
| WO | 0183647 | | 11/2001 |
| WO | 0183648 | | 11/2001 |
| WO | 03004588 | | 1/2003 |
| WO | WO03004588 | * | 1/2003 |
| WO | 2004078885 | | 9/2004 |
| WO | WO2004078885 | * | 9/2004 |
| WO | 2005054411 | | 6/2005 |
| WO | WO2005054411 | * | 6/2005 |

OTHER PUBLICATIONS

Wei, Danping et al., "The Lubricity of Diesel Fuels", Wear, III, pp. 217-235, 1986.

Schoenmakers, P.J., et al.; J. Chromatogr. A, 892 (2000) p. 29 and further.

Van Der Burgt et al.; "The Shell Middle Distillate Synthesis Process"; 5th Synfuels Worldwide Symposium, Washington DC, Nov. 1985.

Audi Communication Motorsport; "Audi Competes with Diesel Sports Car at LeMans"; Presentation of the new Audi R10 in Paris; 2 pages; Dec. 13, 2005; taken from internet http://www.audiworld.com/new/05/r10/diesel/content.shtml.

Krahl, J., et al; "Fuel Design as Constructional Element with the Example of Biogenic and Fossil Diesel Fuels"; Agricultural Engineering Internationa: the CIGR Ejournal, vol. VII; Manuscript EE 04 008; 11 pages; Mar. 2005.

* cited by examiner

*Primary Examiner* — James Goloboy
*Assistant Examiner* — Chantel Graham

(57) ABSTRACT

Fuel compositions containing a hydrocarbon blend having a cetane number of at least 62, a kinematic viscosity at 40° C. of greater than 3.0 cSt and a density at 15° C. of greater than 830 kg/m$^3$ is disclosed. The Wear Scar value of the fuel composition is below 350 microns as determined by CEC-F-06-A-96 and/or contains (b) a paraffinic fuel boiling in the gas oil range comprising more than 90 wt % paraffins and having a cetane number of between 70 and 85 in combination with (a) a mineral derived gas oil having a density at 15° C. of between 800 and 860 kg/m$^3$ and a kinematic viscosity at 40° C. of between 1.5 and 15 cSt (mm$^2$/s) and/or (c) a naphthenic rich blending component boiling in the gas oil range having a density at 15° C. of greater than 860 kg/m$^3$ and having a pour point of below −30° C.

12 Claims, No Drawings

DIESEL FUEL COMPOSITIONS

FIELD OF THE INVENTION

The present invention relates to a fuel composition suited for compression ignition engines, particularly to racing fuels.

BACKGROUND OF THE INVENTION

Fuel compositions suited for compression ignition engines are sometimes also referred to as diesel fuel. There is a trend in car racing to compete with cars having a compression ignition engine. Special interest exists to participate with such cars in endurance racing. In such races the competing cars will run for a specific time, for example 24 hours, on a race track and the car which makes the most laps wins. In such races pit stops are allowed for refueling. When formulating the best fuel for such a race, one will have to meet minimum requirements regarding the power of the fuel and the volumetric fuel consumption. Power is evidently important for a racing fuel. The volumetric fuel consumption is, however, also important because it will determine the number of required pit stops during the race.

The above attributes of the racing fuel would also be attractive to drivers of cars used on the highway. An object is thus also to obtain a racing fuel, which will comply with the governmental specifications for diesel fuel, such as DIN EN 590 in Europe. In this manner an improved fuel is obtained which may also find use as a consumer product for normal use, other than as a racing fuel.

SUMMARY OF THE INVENTION

In one embodiment a fuel composition is provided comprising a hydrocarbon blend having a cetane number of at least 62, a kinematic viscosity at 40° C. of greater than 3.0 cSt ($mm^2/s$) and a density at 15° C. of greater than 830 $kg/m^3$, wherein the Wear Scar value of the fuel composition is below 350 microns (μm) as determined by CEC-F-06-A-96.

In another embodiment a fuel composition is provided comprising a hydrocarbon blend having a cetane number of at least 62, a kinematic viscosity at 40° C. of greater than 3.0 cSt ($mm^2/s$) and a density at 15° C. of greater than 830 $kg/m^3$, wherein the fuel composition comprises (b) a paraffinic fuel boiling in the gas oil range comprising more than 90 wt % paraffins and having a cetane number of between 70 and 85 in combination with (a) a mineral derived gas oil having a density at 15° C. of between 800 and 860 $kg/m^3$ and a kinematic viscosity at 40° C. of between 1.5 and 15 cSt ($mm^2/s$) and/or (c) a naphthenic rich blending component boiling in the gas oil range having a density at 15° C. of greater than 860 $kg/m^3$ and having a pour point of below −30° C.

DETAILED DESCRIPTION OF THE INVENTION

It has now been found that the following fuel composition is an excellent racing fuel for use in compression ignition engines. Thus, a fuel composition according to the present invention comprises a hydrocarbon blend having a cetane number of at least 62, a kinematic viscosity at 40° C. of greater than 3.0 cSt ($mm^2/s$) and a density at 15° C. of greater than 830 $kg/m^3$, wherein the Wear Scar value of the fuel composition is below 350 microns (μm) as determined by CEC-F-06-A-96.

It has been found that fuel compositions according to the present invention perform well in terms of volumetric fuel composition and power when compared to the typical consumer fuels.

The fuel composition preferably has a density at 15° C. of below 845 $kg/m^3$. The cetane number, as measured according to DIN 51773, is preferably at least 63. The upper limit of the cetane number will be determined by the compositional constraints of the base fuels used to formulate such a composition and the cetane improver additives present in the formulation. A practical upper limit will be 80. The aromatic content, as determined by IP 391, will typically be below 30 wt % and preferably less than 20 wt %. Compositions having between 5 and 20 wt % of aromatics have been found suited as racing fuel. The content of di/tri and poly-aromatics in the composition as determined by IP 391 is preferably less than 11% and more preferably less than 5%. The pour point, cloud point and cold filter plugging point (CFPP) of the fuel composition will depend on the climate conditions in which the fuel composition will be used. The values for all these properties may range from minus 40° C. to +5° C. The fuel composition will suitably have a 90% v/v distillation temperature (T90) of from 300 to 370° C., preferably below 360° C. and more preferably between 310 and 360° C. The kinematic viscosity at 40° C. is preferably less than 4.5 cSt ($mm^2/s$) in order to meet the governmental specifications.

The fuel composition preferably comprises one or more additives. Examples of suitable additives are lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; and combustion improvers.

Examples of detergents suitable for use in fuel additives for the present purpose include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described, for example, in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

It has been found that it is particularly preferred that the fuel composition comprises a lubricity enhancer additive in order to improve the Wear Scar value (HFRR) of the fuel. Preferably, the content of lubricity additive is such that the Wear Scar value of the fuel composition has a resultant value of below 300 microns (μm). The content of lubricity additive needed to achieve such values will depend on the lubricity of the base fuels used to formulate the fuel composition according to the present invention. It is found that especially in fuel compositions wherein the sulphur content is lower than 500 ppmw, the lubricity additive is preferably present at a concentration of between 50 and 1000 ppmw, preferably between 100 and 1000 ppmw.

Suitable commercially available lubricity enhancers include ester- and acid-based additives. Other lubricity enhancers are described in the patent literature, in particular in connection with their use in low sulphur content diesel fuels, for example in:

- the paper by Danping Wei and H. A. Spikes, "*The Lubricity of Diesel Fuels*", Wear, III (1986) 217-235;
- WO-A-95/33805—cold flow improvers to enhance lubricity of low sulphur fuels;
- WO-A-94/17160—certain esters of a carboxylic acid and an alcohol wherein the acid has from 2 to 50 carbon atoms and the alcohol has 1 or more carbon atoms, particularly glycerol monooleate and di-isodecyl adipate, as fuel additives for wear reduction in a diesel engine injection system;
- U.S. Pat. No. 5,490,864—certain dithiophosphoric diester-dialcohols as anti-wear lubricity additives for low sulphur diesel fuels; and
- WO-A-98/01516—certain alkyl aromatic compounds having at least one carboxyl group attached to their aromatic nuclei, to confer anti-wear lubricity effects particularly in low sulphur diesel fuels.

The fuel composition as described above having the unique combination of a relatively high density and viscosity in combination with a relatively high cetane number may be suitably obtained by blending (b) a paraffinic fuel boiling in the gas oil range with (a) a mineral derived gas oil and/or with (c) a naphthenic rich blending component boiling in the gas oil range.

The present invention is also directed to a fuel composition comprising a hydrocarbon blend having a cetane number of at least 62, a kinematic viscosity at 40° C. of greater than 3.0 cSt and a density at 15° C. of greater than 830 kg/m$^3$, wherein the fuel composition comprises (b) a paraffinic fuel boiling in the gas oil range comprising more than 90 wt % paraffins and having a cetane number of between 70 and 85 in combination with (a) a mineral derived gas oil having a density at 15° C. of between 800 and 860 kg/m$^3$ and a kinematic viscosity at 40° C. of between 1.5 and 15 cSt (mm$^2$/s) and/or (c) a naphthenic rich blending component boiling in the gas oil range having a density at 15° C. of greater than 860 kg/m$^3$ and having a pour point of below −30° C., the Wear Scar value of said fuel composition preferably being below 350 microns as determined by CEC-F-06-A-96, and said fuel composition preferably comprising between 5 and 70 vol % of the paraffinic fuel (b), between 5 and 70 vol % of naphthenic component (c) and between 0 and 90 vol % of component (a) and wherein the volumetric ratio between component (b) and component (c) is between 1:2 and 2:1.

Component (a) is a mineral derived gas oil. Such a gas oil, boiling in the gas oil range, will preferably have an aromatics content of below 30 wt %. Such mineral derived gas oil products may be straight run derived distillate fractions from a mineral crude source or from a gas condensate source or the products of a refinery fuels hydrocracker. The straight run fractions are preferably subjected to a de-sulphurization step in order to reduce the sulphur content to a level suited to meet the local requirements. Due to the preferred aromatics content the density will suitably be between 800 and 860 kg/m$^3$. The cetane number may range from 40 to 65. Its kinematic viscosity at 40° C. (ASTM D445) might suitably be from 1.5 to 15 cSt (mm$^2$/s). It may appear that the above property ranges for the mineral gas oil components overlap the properties of the fuel composition. However, no mineral gas oil products are known to have the specific combination of density, viscosity and cetane number of the fuel composition according to the present invention.

Component (b) is a paraffinic fuel. With a paraffinic fuel in the context of the present invention is meant a composition comprising more than 80 wt % paraffins, more preferably more than 90 wt % paraffins and even more preferably more than 95 wt % paraffins. The iso to normal ratio of the paraffins as present in the paraffinic fuel is preferably greater than 0.3, more preferably greater than 1, even more preferably greater than 3. The paraffinic fuel may comprise substantially only iso-paraffins.

The iso to normal ratio and the paraffin content of the paraffinic fuel in the context of the present invention are measured by means of comprehensive multi-dimensional gas chromatography (GCxGC), as described in P. J. Schoenmakers, J. L. M. M. Oomen, J. Blomberg, W. Genuit, G. van Velzen, J. Chromatogr. A, 892 (2000) p. 29 and further.

The paraffinic fuel suitably has a density from 760 to 790 kg/m$^3$ at 15° C.; a cetane number (DIN 51773) greater than 70, suitably from 74 to 85; a kinematic viscosity from 2.0 to 4.5, preferably from 2.5 to 4.0, more preferably from 2.9 to 3.7, cSt (mm$^2$/s) at 40° C.; and a sulphur content of 5 ppmw (parts per million by weight) or less, preferably of 2 ppmw or less.

The paraffin fuel components may be obtained by oligomerisation of lower boiling olefins. More preferably, the paraffin gas oil component is prepared by means of a Fischer-Tropsch condensation process. The Fischer-Tropsch reaction converts carbon monoxide and hydrogen into longer chain, usually paraffinic, hydrocarbons:

$$n(CO+2H_2)=(—CH_2—)_n+nH_2O+\text{heat},$$

in the presence of an appropriate catalyst and typically at elevated temperatures (e.g. 125 to 300° C., preferably 175 to 250° C.) and/or pressures (e.g. 500 to 10000 kPa, preferably 1200 to 5000 kPa). Hydrogen:carbon monoxide ratios other than 2:1 may be employed if desired.

The carbon monoxide and hydrogen may themselves be derived from organic or inorganic, natural or synthetic sources, typically either from coal, biomass, for example wood chips and organic waste, bituminous oils, natural gas or from organically derived methane.

A gas oil product may be obtained directly from this reaction, or indirectly for instance by fractionation of a Fischer-Tropsch synthesis product or from a hydrotreated Fischer-Tropsch synthesis product. Hydrotreatment can involve hydrocracking to adjust the boiling range (see, e.g. GB-B-2077289 and EP-A-0147873) and/or hydroisomerisation, which can improve cold flow properties by increasing the proportion of branched paraffins. EP-A-0583836 describes a two-step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired gas oil fraction(s) may subsequently be isolated for instance by distillation.

The paraffinic gas oil is preferably obtained in a process which involves a step where the paraffins are catalytically isomerized, to a substantially 100% iso-paraffinic fuel, in the presence of a suitable catalyst comprising a medium pore size zeolite and a noble metal hydrogenation component. It has been found that the gas oils as obtained have excellent lubricity values. This would allow the formulator of the fuel composition to use less of the lubricity additive. An example of a process to make such a paraffinic gas oil component is described in WO-A-03/070857.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for example in EP-A-0583836 (pages 3 and 4).

An example of a Fischer-Tropsch based process is the SMDS (Shell Middle Distillate Synthesis) described in "The Shell Middle Distillate Synthesis Process", van der Burgt et al (paper delivered at the 5th Synfuels Worldwide Symposium, Washington D.C., November 1985; see also the November 1989 publication of the same title from Shell International Petroleum Company Ltd., London, UK). This process (also sometimes referred to as the Shell™ "Gas-to-Liquids" or "GTL" technology) produces middle distillate range products by conversion of a natural gas (primarily methane) derived synthesis gas into a heavy long-chain hydrocarbon (paraffin) wax which can then be hydroconverted and fractionated to produce liquid transport fuels such as the gas oils useable in diesel fuel compositions. A version of the SMDS process, utilising a fixed-bed reactor for the catalytic conversion step, is currently in use in Bintulu, Malaysia and its products have been blended with petroleum derived gas oils in commercially available automotive fuels.

Gas oils prepared by the SMDS process are commercially available from Shell companies. Further examples of Fischer-Tropsch derived gas oils are described in EP-A-0583836, EP-A-1101813, WO-A-97/14768, WO-A-97/14769, WO-A-00/20534, WO-A-00/20535, WO-A-00/11116, WO-A-00/11117, WO-A-01/83406, WO-A-01/83641, WO-A-01/83647, WO-A-01/83648 and U.S. Pat. No. 6,204,426.

By virtue of the Fischer-Tropsch process, a Fischer-Tropsch derived gas oil has essentially no, or undetectable levels of, sulphur and nitrogen. Compounds containing these heteroatoms tend to act as poisons for Fischer-Tropsch catalysts and are therefore removed from the synthesis gas feed. Further, the process as usually operated produces no or virtually no aromatic components. The aromatics content of a Fischer-Tropsch gas oil will typically be below 1% w/w, preferably below 0.5% w/w and more preferably below 0.1% w/w.

Component (c) is a naphthenic component. The naphthenic blending component will comprise a large content of naphthenic components boiling in the gas oil range. Because of this feature the density will be relatively high, preferably above 860 kg/m$^3$. Another typical property of the preferred naphthenic blending component is the low pour point. Preferably the pour point of the blending component is below −30° C. and more preferably below −40° C. The content of aromatic compounds is preferably below 30 wt %, more preferably below 20 wt % according to IP 391. Due to the low contribution to the cetane number of naphthenic compounds, the cetane number will be typically lower than 50. The kinematic viscosity at 40° C. of the naphthenic blending component is preferably between 6 and 30 cSt (mm$^2$/s).

Naphthenic blending components may be derived from so-called naphthenic crude sources, by hydrogenation of light cycle oils as obtained in a catalytic cracking process. Alternatively the naphthenic compounds may be made by means of a synthetic route. Examples of suitable naphthenic blending components are the commercially available products named 'Shell Oil 4308' as obtainable from Deutsche Shell GmbH.

The fuel composition according to the present invention is particularly applicable where the fuel composition is used or intended to be used in a direct injection diesel engine, for example of the rotary pump, in-line pump, unit pump, electronic unit injector or common rail type, or in an indirect injection diesel engine. The fuel composition may be suitable for use in heavy and/or light duty diesel engines. It has been found that the fuel composition is particularly suited for use as a racing fuel in any one of the above engines. The present invention is also directed to the method of operating a diesel powered car in a race which lasts between 5 and 30 hours, by running the diesel powered car with the fuel composition, wherein the engine can be any of the above described engines, in particular in a race car equipped with a turbocharged direct injection diesel engine and equipped with a so-called advanced common rail injection system working at a rail pressure of above 1600 bar.

The present invention will now be described by way of the following examples which are not intended to limit the scope of the claims:

EXAMPLE 1

This example illustrates the effects on the responsiveness of a first engine using Fischer-Tropsch derived diesel fuel.

Test Fuels

Fuel compositions were made using the four blending components listed in Table 1:

TABLE 1

| Fuel property | Mineral gas oil component (a) | Fischer-Tropsch derived fuel (b1) | Fischer-Tropsch derived fuel (b2) | Naphthenic blending component (c) | Standard Diesel |
|---|---|---|---|---|---|
| Density @ 15° C. (ASTM D4502), kg/m$^3$ | 840 | 779 | 785 | 879 | 827 |
| Cloud Point (DIN EN 23015), ° C. | −5 | −17 | 0 | <−50 | −7 |
| Pour point (DIN EN ISO 3016), ° C. | nd- | nd- | −2 | <−50 | — |
| Distillation | | | | | |
| Initial boiling point, ° C. | 191 | 206 | 212 | 282 | 163 |
| T50, ° C. | 275 | 272 | 297 | 308 | 258 |
| T90, ° C. | 331 | 310 | 343 | 332 | 338 |
| Final boiling point, ° C. | 356 | 321 | 357 | 349 | 364 |
| Cetane number (DIN 51773) | 57.5 | 74.2 | 79.7 | 43.7 | 53.9 |
| Kinematic viscosity @ 40° C. (DIN EN ISO 3104), mm$^2$/s | 2.7 | 2.7 | 3.4 | 8 | 2.3 |
| Sulphur (DIN 51400 T 11), mg/kg | <10 | <5 | <5 | <10 | <10 |
| Aromatic content (IP391), % m | 21.6 | 0.3 | 0.3 | 17.5 | 21 |

nd = not determined

Test Blends

In the following tests, blends F1, F2, F3, F4, F5 and F6 were compared, blends F3 and F4 being according to the present invention. All blends contained the same additive package, typical for a premium diesel engine fuel, and 250 ppmw of a lubricity additive. Details of these blends are shown in Table 2:

TABLE 2

| Description | | Blend No. F1 | F2 | F3 | F4 | F5 | F6 |
|---|---|---|---|---|---|---|---|
| Component a | Vol % | 80 | 69.0 | 62.0 | 49.0 | 66.0 | 87.0 |
| Component b1 | Vol % | 20 | 6.25 | 6.25 | 7.5 | 5.25 | 3.25 |
| Component b2 | Vol % | 0 | 18.75 | 18.75 | 22.5 | 15.75 | 9.75 |
| Component c | Vol % | 0 | 6.0 | 13.0 | 21.0 | 13.0 | 0 |
| Cetane number | — | 59.7 | 63.2 | 63.0 | 63.2 | 60.3 | 60.4 |
| Kinematic viscosity @40° C. | cSt ($mm^2/s$) | 3.1 | 3.3 | 3.5 | 3.7 | 3.5 | 3.2 |
| Total Aromatics | Wt % | 17.4 | 16.3 | 15.9 | 14.6 | 17.2 | 19.0 |
| Di/Tri/Poly Aromatics | Wt % | 2.2 | 1.9 | 1.8 | 1.6 | 1.9 | 2.2 |
| Density @ 15° C. | $kg/m^3$ | 828.0 | 828.6 | 831.3 | 831.7 | 833.6 | 833.0 |
| Cloud Point | ° C. | −7 | −6 | −6 | −7 | −5 | −6 |
| CFPP | ° C. | −9 | −8 | −10 | −9 | −8 | −9 |
| Pour Point | ° C. | −12/−9 | −10 | −9 | −12 | −10 | −10 |
| IBP | ° C. | 197.7 | 194.6 | 197.1 | 202.7 | 192.5 | 192.8 |
| T50 | ° C. | 274.7 | 282.1 | 286.2 | 291.3 | 285.7 | 277.0 |
| T90 | ° C. | 326.0 | 334.8 | 336.6 | 337.6 | 337.5 | 332.7 |
| FBP | ° C. | 354.0 | 323.8 | 325.5 | 328.1 | 360.8 | 359.4 |
| HFRR | μm | 265 | 230 | 240 | 277 | 217 | 271 |

The blends of Table 2 were tested in a race car equipped with a V12 turbocharged direct injection diesel engine and equipped with an advanced common rail injection system having a cubic capacity of 5.5 litre. The results are presented in Table 3:

TABLE 3

| Difference in performance relative to base fuel F1 | | F1 | F2 | F3 | F4 | F5 | F6 |
|---|---|---|---|---|---|---|---|
| Difference in maximum Power | KW | 0 | 0.09 | 1.3 | 0.38 | −0.96 | 0.54 |
| Difference in maximum torque | Nm | 0 | −0.47 | 3.35 | 0.93 | −4.26 | 1.85 |
| Difference in mass fuel consumption | G/kW * h | 0 | −0.08 | −0.04 | −0.63 | 1.44 | 0.51 |
| Difference in volumetric fuel consumption | L/kW * h | 0 | −0.68 | −1.71 | −2.53 | −0.18 | −1.38 |

The results in Table 3 should be read as follows. A positive value for KW and Nm is an improved performance relative to Fuel F1. A negative value for the consumption properties (G/kW*h and L/kW*h) is an improvement relative to Fuel F1. For example Fuel F3 shows an improved power and torque in combination with a lower mass and volume consumption. These are attractive properties for a racing fuel as well as for a consumer highway fuel.

EXAMPLE 2

Fuel F3 of Table 2 has also been compared with a Standard Diesel of Table 1 in a BMW 320d having the specifications as listed in Table 4.

The difference in maximum Power was 0.84 KW and the difference in maximum torque 3.68 Nm. These results show that also in a typical diesel car suited for non-racing use an improvement in power and torque is achieved when using the fuel composition according to the present invention.

TABLE 4

| | |
|---|---|
| Type | BMW 320d |
| Number of cylinders | 4 |
| Swept volume | 1995 $cm^3$ |
| Bore | 84.0 mm |
| Stroke | 90.0 mm |
| Number of cylinders | 4 |
| Nominal compression ratio | 17.0:1 |
| Maximum power (boosted) | 150 brake horsepower (110 kilowatts) @ 4000 rpm (DIN) |
| Maximum torque (boosted) | 330 Nm (DIN) @ 2000 rpm |

I claim:

1. A method of operating a diesel powered car in a race, the method comprising:

operating the diesel powered car in the race over a period ranging of from about 5 hours up to about 30 hours;

the operating comprising burning a fuel composition comprising an improved fuel blend comprising (a) a first amount of mineral derived gas oil, (b) 25 vol % or more to 30 vol % or less of paraffinic fuel, and (c) 21 vol % or less of a naphthenic rich blending component having a kinematic viscosity at 40° C. of between 6 and 30 cSt, the improved fuel blend having a cetane number of at least 62, a kinematic viscosity at 40° C. of greater than 3.0 cSt ($mm^2/s$), and a density at 15° C. of greater than 830 $kg/m^3$; wherein the Wear Scar value of the fuel composition is below 350 microns (μm), as determined by CEC F 06 A 96, and the improved fuel blend comprises a volumetric ratio between component (b) and component (c) of between 1:2 and 2:1.

2. A fuel composition comprising:

an improved fuel blend having a cetane number of at least 62, a kinematic viscosity at 40° C. of greater than 3.0 cSt ($mm^2/s$), and a density at 15° C. of greater than 830 $kg/m^3$;

wherein the improved fuel blend comprises (b) 25 vol % or more to 30 vol % or less of a paraffinic fuel boiling in the gas oil range comprising more than 90 wt % paraffins and having a cetane number of between 70 and 85 in combination with (c) 21 vol % or less of a naphthenic rich blending component boiling in the gas oil range having a density at 15° C. of greater than 860 $kg/m^3$, a kinematic viscosity at 40° C. of between 6 and 30 cSt, and a pour point of below −30° C., and (a) a mineral derived gas oil having a density at 15° C. of between 800 and 860 kg/m$^3$ and a kinematic viscosity at 40° C. of between 1.5 and 15 cSt (mm$^2$/s); wherein the improved fuel blend comprises a volumetric ratio between component (b) and component (c) of between 1:2 and 2:1.

3. The fuel composition of claim 2 wherein the Wear Scar value of the fuel composition is below 350 microns (μm) as determined by CEC-F-06-A-96.

4. The fuel composition of claim 2 wherein the paraffinic fuel is prepared by means of a Fischer Tropsch condensation process.

5. A fuel composition comprising:

an improved fuel blend having a cetane number of at least 62, a kinematic viscosity at 40° C. of greater than 3.0 cSt (mm$^2$/s), and a density at 15° C. of greater than 830 kg/m$^3$;

wherein the improved fuel blend comprises (b) 25 vol % or more to 30 vol % or less of a paraffinic fuel prepared by means of a Fischer Tropsch condensation process, the paraffinic fuel boiling in the gas oil range, comprising more than 90 wt % paraffins, and having a cetane number of between 70 and 85 in combination with (c) 21 vol % or less of a naphthenic rich blending component boiling in the gas oil range having a density at 15° C. of greater than 860 kg/m$^3$, a kinematic viscosity at 40° C. of between 6 and 30 cSt, and having a pour point of below −30° C.; and (a) a mineral derived gas oil having a density at 15° C. of between 800 and 860 kg/m$^3$ and a kinematic viscosity at 40° C. of between 1.5 and 15 cSt (mm$^2$/s);

wherein the fuel composition exhibits a Wear Scar value of below 350 microns (μm), as determined by CEC-F-06-A-96, and the improved fuel blend comprises a volumetric ratio between component (b) and component (c) of between 1:1 to 2:1.

6. A fuel composition comprising:

an improved fuel blend having a cetane number of at least 62, a kinematic viscosity at 40° C. of greater than 3.0 cSt (mm$^2$/s), and a density at 15° C. of greater than 830 kg/m$^3$;

wherein the improved fuel blend comprises (b) 25 vol % or more to 30 vol % or less of a paraffinic fuel prepared by a Fischer Tropsch condensation process, the paraffinic fuel boiling in the gas oil range, comprising more than 90 wt % paraffins, and having a cetane number of between 70 and 85, in combination with (c) 21 vol % or less of a naphthenic rich blending component boiling in the gas oil range having a density at 15° C. of greater than 860 kg/m$^3$, a kinematic viscosity at 40° C. of between 6 and 30 cSt, and having a pour point of below −30° C., and (a) up to about between 0 and 90 vol % of a mineral derived gas oil having a density at 15° C. of between 800 and 860 kg/m$^3$ and a kinematic viscosity at 40° C. of between 1.5 and 15 cSt (mm$^2$/s);

wherein the improved fuel blend comprises a volumetric ratio between component (b) and component (c) of between 1:2 and 2:1.

7. The fuel composition of claim 6 exhibiting a Wear Scar value of below 350 microns (μm), as determined by CEC-F-06-A-96.

8. A fuel composition comprising:

an improved fuel blend comprising:

(a) mineral derived gas oil having a density at 15° C. of between 800 and 860 kg/m$^3$ and a kinematic viscosity at 40° C. of between 1.5 and 15 cSt (mm$^2$/s);

(b) from 25 vol % or more to 30 vol % or less paraffinic fuel boiling in the gas oil range comprising more than 90 wt % paraffins and having a cetane number of between 70 and 85 in combination with; and, (c) from 21 vol % or less of naphthenic rich blending component boiling in the gas oil range having a density at 15° C. of greater than 860 kg/m$^3$, a kinematic viscosity at 40° C. of between 6 and 30 cSt, and a pour point of below −30° C.;

the improved fuel blend having a cetane number of at least 62, a kinematic viscosity at 40° C. of greater than 3.0 cSt (mm$^2$/s) and a density at 15° C. of greater than 830 kg/m$^3$.

9. The fuel composition of claim 8 wherein the paraffinic fuel (b) is prepared by means of a Fischer Tropsch condensation process.

10. The fuel composition of claim 8 wherein the naphthenic rich blending component has a cetane number of lower than 50.

11. The method of claim 8 wherein operating the diesel powered car burning the fuel composition comprising the improved fuel blend produces a Wear Scar value of below 350 microns (μm), as determined by CEC F 06 A 965.

12. A fuel composition for use in a diesel engine, said fuel composition comprising:

(a) a mineral derived gas oil, said gas oil having a density at 15° C. of between 800 and 860 kg/m$^3$ and a kinematic viscosity at 40 C of between about 1.5 and 15 cSt (mm$^2$/s);

(b) a paraffinic fuel component, said paraffinic fuel component comprising more than 90% by weight paraffins, a density at 15° C. of between 760 and 790 kg/m$^3$, a kinematic viscosity at 40° C. of between 2.5 and 4.0 cSt, and having a cetane number of between 70 and 85; and (c) a naphthenic-rich blending component, said naphthenic blending component having a boiling point in the gas oil range, a density at 15° C. of greater than 860 kg/m$^3$, a kinematic viscosity at 40° C. of between 6 and 30 cSt, an aromatic content of less than 30% by weight, and a pour point of less than −30° C.;

wherein the paraffinic component (b) is present in an amount of between 25% by volume and 30% by volume and the naphthenic-rich blending component is present in an amount up to 21% by volume;

wherein the fuel composition comprises a cetane number of at least 62, a kinematic viscosity at 40° C. between 3.0 cSt (mm$^2$/s) and 4.5 cSt (mm$^2$/s), a density at 15° C. greater than 830 kg/m$^3$, and a T90 distillation temperature of between 300° C. and 370° C.

* * * * *